US005417296A

United States Patent [19]

Murdock

[11] Patent Number: 5,417,296

[45] Date of Patent: May 23, 1995

[54] ROTARY DRILL BITS

[75] Inventor: Andrew D. Murdock, Stroud, England

[73] Assignee: Camco Drilling Group Limited

[21] Appl. No.: 236,475

[22] Filed: May 2, 1994

[30] Foreign Application Priority Data

May 8, 1993 [GB] United Kingdom ..... 9309498

[51] Int. Cl.[6] ..... E21B 10/60

[52] U.S. Cl. ..... 175/393

[58] Field of Search ..... 175/393, 340, 339

[56] References Cited

U.S. PATENT DOCUMENTS

| | | | |
|---|---|---|---|
| 3,112,803 | 12/1963 | Rowley | 175/329 |
| 4,577,706 | 3/1986 | Barr | 175/393 X |
| 4,727,946 | 3/1988 | Barr et al. | 175/393 X |
| 4,733,734 | 3/1988 | Bardin et al. | 175/393 X |
| 4,738,320 | 4/1988 | Bardin et al. | 175/393 X |

FOREIGN PATENT DOCUMENTS

| | | |
|---|---|---|
| 0171915 | 5/1989 | European Pat. Off. . |
| 8401186 | 3/1984 | WIPO . |

*Primary Examiner*—Hoang C. Dang

[57] ABSTRACT

A drill bit has a plurality of radial blades on its leading face which define fluid channels leading to junk slots in the gauge region, cutting elements being mounted along each blade. At least two of the channels are in communication with one another at their inner ends and there is provided, at the communicating inner ends of the channels, an inner nozzle which is angled to direct the majority of drilling fluid emerging from the nozzle outwardly along one of the channels. An outer nozzle is located in the other channel, adjacent its junk slot, and is angled so that the majority of fluid emerging from the outer nozzle flows inwardly along said other channel and towards the inner nozzle.

4 Claims, 2 Drawing Sheets

ROTARY DRILL BITS

BACKGROUND OF THE INVENTION

The invention relates to rotary drill bits for use in drilling holes in subsurface formations and particularly to drag type drill bits of the kind comprising a bit body having a leading face and a gauge region, a plurality of blades formed on the leading face of the bit and extending outwardly away from the axis of the bit towards the gauge region so as to define between the blades a plurality of fluid channels leading to junk slots in the gauge region, a plurality of cutting elements mounted along each blade, and a plurality of nozzles in the leading face of the bit for supplying drilling fluid to the channels for cleaning and cooling the cutting elements.

One of the major problems in designing a drill bit of this type lies in positioning and orientating the nozzles so as to provide the most effective flow pattern of drilling fluid along the channels and across the cutting elements to obtain the optimum cleaning and cooling effect. The flow of drilling fluid emerging from the nozzles and impinging on the surface of the formation being drilled also serves to cool the formation.

Normally the nozzles are located in the area around the central axis of rotation of the bit so that substantially all of the drilling fluid emerging from the nozzles flows outwardly along the channels with which each nozzle communicates, so as to wash over the cutting elements facing into the channels. Arrangements are known in which these nozzles are slightly angled with respect to the surface of the bit body so that the drilling fluid emerges from the nozzle in a direction having a component along a particular channel. However, where a nozzle is feeding two or more channels it may be undesirable to direct the flow along a particular channel.

Another requirement for the flow of drilling fluid is effectively to remove and clear from the channels the cuttings which are removed from the formation by the cutting element as drilling proceeds. In soft and sticky formations there may be a tendency for such cuttings to accumulate or "ball" in the channels and it is necessary that the flow of drilling fluid should be capable of preventing or clearing such accumulations since otherwise the cutting elements facing into a blocked channel may become ineffective for drilling.

Many different designs of drill bit, and arrangements of nozzles, have been proposed in an endeavour to meet these requirements. In International Specification No. WO84/01186 there is shown an arrangement in which nozzles are provided near the outer periphery of the drill bit instead of near the centre. In such arrangement there are not provided junk slots directly adjacent the peripheral nozzles so that the drilling fluid emerging from the nozzles cannot flow directly up the annulus between the drill String and the bore hole. Instead, the blades and channels are so arranged that drilling fluid emerging from the peripheral nozzles flows first inwardly along one channel towards the centre of the drill bit and then flows outwardly again along a further channel leading to a junk slot.

In European Specification No. 0171915 arrangements are shown in which conventional nozzles in near the axis of the drill bit are supplemented by peripheral nozzles nearer the gauge region which are so arranged in relation to the adjacent blades that drilling fluid from the peripheral nozzles flows substantially tangentially in a peripheral direction around the outer periphery of the drill bit so as to cool and clean cutting elements which lie in the peripheral flow path between each peripheral nozzle and the nearest junk slot.

The present invention provides an improved arrangement where nozzles near the central axis of the drill bit are supplemented by peripheral nozzles nearer the gauge region, the nozzles being so located and orientated as to provide an improved effect when compared with the prior art arrangements.

SUMMARY OF THE INVENTION

According to the invention there is provided a rotary drill bit for use in drilling holes in subsurface formations comprising a bit body having a leading face and a gauge region, a plurality of blades formed on the leading face of the bit and extending outwardly away from the axis of the bit towards the gauge region so as to define between the blades a plurality of fluid channels leading to junk slots in the gauge region, a plurality of cutting elements mounted along each blade, and a plurality of nozzles in the leading face of the bit for supplying drilling fluid to the channels for cleaning and cooling the cutting elements, wherein at least two of said channels are in communication with one another at their inner ends and both lead to respective junk slots at their outer ends, and wherein there is provided, in the vicinity of said communicating inner ends of the channels, an inner nozzle which is angled with respect to the surface of the bit body to direct drilling fluid in a direction having a component outwardly along one of said two channels, so as to direct the majority of fluid emerging from said nozzle outwardly along said one channel, and an outer nozzle, located in the other of said two channels adjacent the respective junk slot, and angled with respect to the surface of the bit body to direct drilling fluid in a direction having a component inwardly along said other channel, so that the majority of fluid emerging from said outer nozzle flows inwardly along said other channel and towards said inner nozzle.

Since the majority of fluid from the inner nozzle is directed to flow outwardly along said one channel, it provides excellent cleaning and cooling of the cutting elements which face into that channel. This outward flow from the inner nozzle may tend to cause a low pressure at the inner end of the other of the two communicating channels. However, this low pressure is fed by the inward flow from the outer nozzle in that channel, and this inward flow from the outer nozzle also serves to clean and cool the cutting elements facing into said other channel. At the same time, since the outer nozzle is adjacent a junk slot, there may also be some outward flow from the outer nozzle to the junk slot.

Preferably said inner nozzle is angled to direct drilling fluid along said one channel in a direction which is generally parallel to the blade along which are mounted the plurality of cutting elements which face into said one channel.

Preferably also the centreline of the flow of drilling fluid from said inner nozzle impinges on the formation, in use, at a radial distance from the central axis of rotation of the drill bit which is greater than the radial distance from the axis of the inner end of the other blade along which said channel extends.

Preferably the inner nozzle is located as close to the central axis of rotation of the drill bit as permitted by the location of the blades and cutting elements.

DETAILED DESCRIPTION OF THE PREFERRED EMBODIMENT

Figure 1:
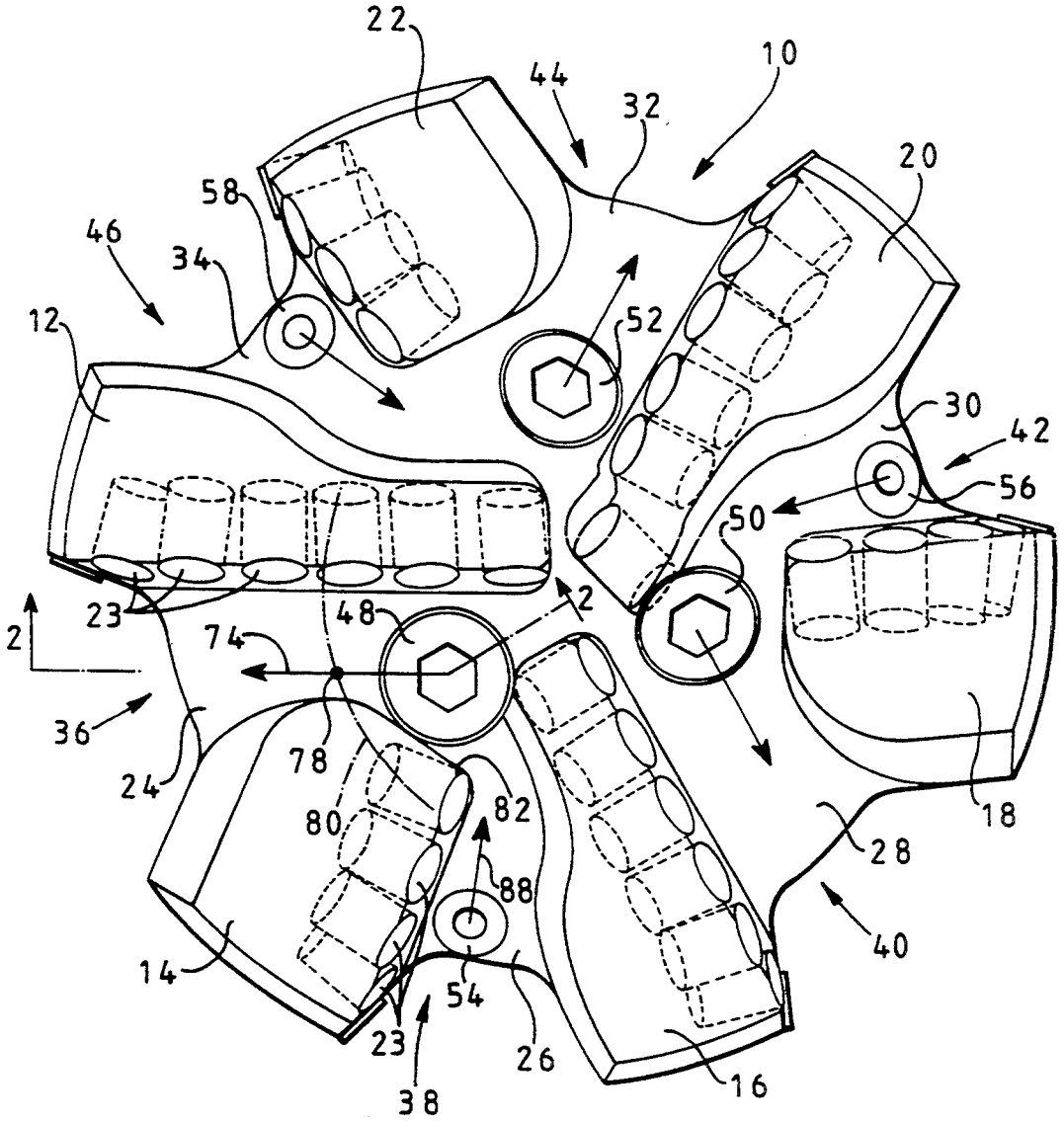
FIG. 1 is a diagrammatic end view of a rotary drill bit in accordance with the invention.

Referring to the drawings: the drill bit comprises a bit body 10 having a leading face and a plurality of blades 12, 14, 16, 18, 20, 22 formed on the leading face of the bit and extending outwardly from the axis of the bit body towards the gauge region. Between adjacent blades there are defined channels 24, 26, 28, 30, 32, 34 which lead respectively to junk slots 36, 38, 40, 42, 44, 46.

The general manner of construction of drag bits of this kind is well known and will not therefore be described in detail. The bit body may be machined from steel or may be moulded from powdered matrix material using a powder metallurgy process. The nozzles 48, 50, 52 may be of generally known form comprising a separate nozzle screwed into a socket in the bit body and formed with an appropriately shaped nozzle aperture.

Inner nozzles for drilling fluid 48, 50 and 52 are mounted in the surface of the bit body and are located close to the central axis of rotation of the bit, being as close to the axis of rotation as is permitted by the location of the blades and cutting elements. Each inner nozzle is located at the inner junction between two adjacent channels. For example, the nozzle 48 is located at the inner junction of the two channels 24 and 26.

Extending side-by-side along each of the blades are a plurality of cutting structures indicated diagrammatically at 23. The precise nature of the cutting structures does not form a part of the present invention and they will not therefore be described in detail. They may be of any appropriate type. For example they may comprise circular preform cutting elements brazed to cylindrical carriers which are embedded or mounted in the blades, the cutting elements each comprising a preform compact having a polycrystalline diamond front cutting layer bonded to a tungsten carbide substrate, the compact being brazed to a cylindrical tungsten carbide carrier.

Associated with the inner nozzles 48, 50, 52 are peripheral nozzles 54, 56, 58 respectively. Each associated peripheral nozzle is located in one of the two channels leading to the inner nozzle, and adjacent the junk slot with which that channel communicates. For example, the peripheral nozzle 54 is located adjacent the junk slot 38 with which communicates the channel 26. The associated inner nozzle 48 lies at the inner junction between the channel 26 and the channel 24.

Figure 2:
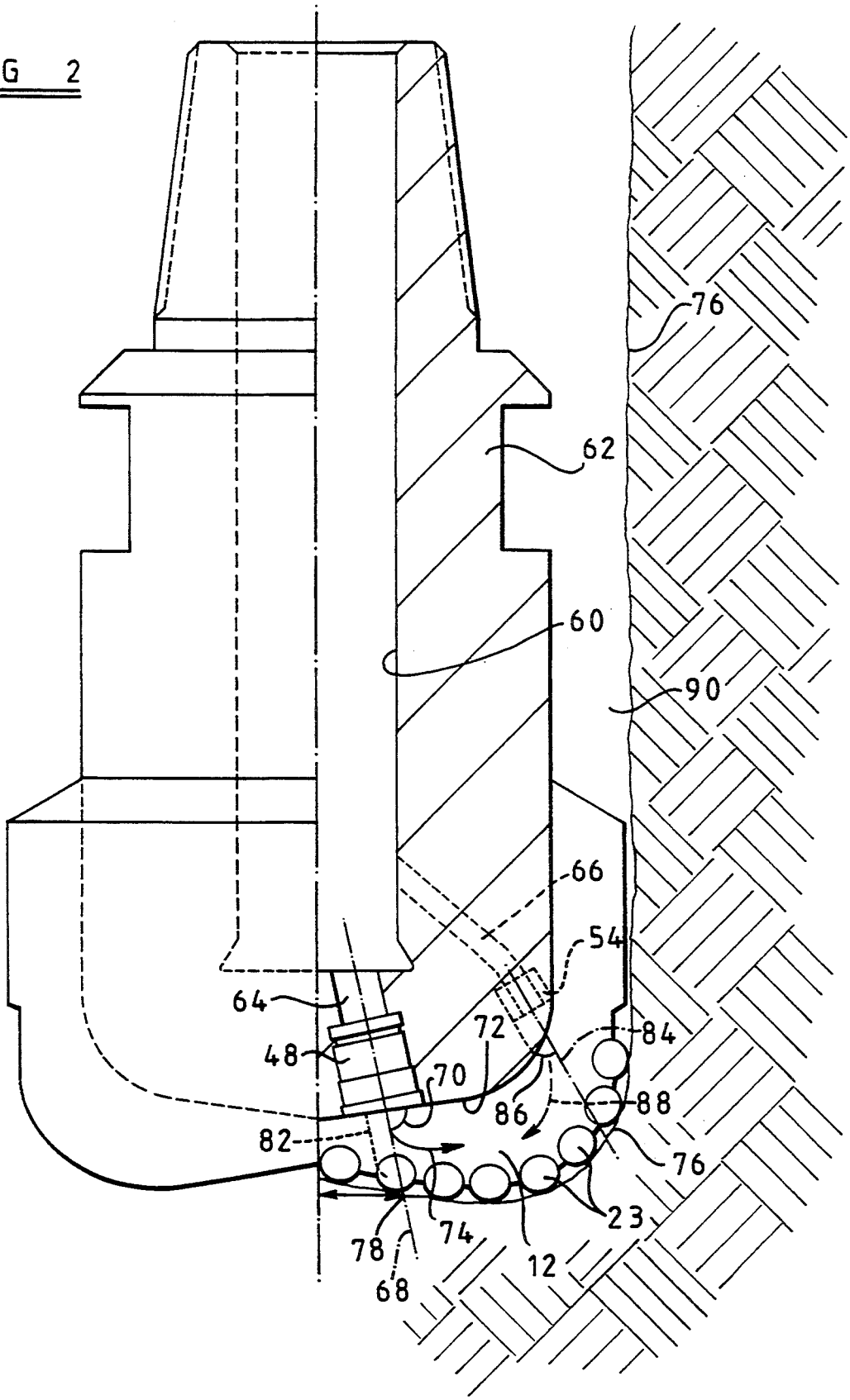
FIG. 2 is a section on the line 2—2 of FIG. 1.

As may be seen from FIG. 2 all of the nozzles communicate with a central axial passage 60 in the shank 62 of the bit to which drilling fluid is supplied under pressure downwardly through the drill string in known manner. Thus, as shown in FIG. 2, the nozzle 48 communicates with the passage 60 through a small passage 64 and the nozzle 54 similarly communicates with the passage 60 through a smaller passage 66.

For convenience, the relative orientation and disposition of the inner and outer nozzles will be described in relation to the pair of nozzles 48, 54. The other pairs of nozzles 50, 56 and 52, 58 may be arranged in corresponding fashion although the invention does not exclude arrangements in which only some pairs of nozzles are arranged in the manner according to the invention. One or more of the other pairs of nozzles may be differently orientated and in some cases there may be provided inner and/or outer nozzles on the bit body which are not arranged to cooperate in pairs as will be described. According to the invention, however, the bit includes at least one such pair of nozzles.

In FIG. 2, therefore, there is shown the inner nozzle 48 and the associated outer nozzle 54 (shown dotted). The nozzle 48 is so orientated with respect to the bit body that its central axis 68 is inclined at an angle 70 to the leading surface 72 of the bit body. The angle 70 is less than 90° so that the flow of drilling fluid emerging from the nozzle 48 has an outward component along the channel 24. The general direction of flow of drilling fluid from the nozzle 48 is indicated by the arrow 74 in FIGS. 1 and 2. As may be seen from FIG. 1, the direction of flow 74 is generally parallel to the face of the blade 12 carrying the cutting structures 23 which face into the channel 24. Accordingly, the majority of the flow of drilling fluid from the nozzle 48 impinges on the formation 76 (see FIG. 2) and flows outwardly along the channel 24 to the junk slot 36. The point where the central axis of the fluid flow from the nozzle 48 impinges on the formation is indicated at 78 in FIGS. 1 and 2. As may be seen from both these figures this point lies at a radial distance from the axis of rotation of the drill bit which is greater than the radial distance of the inner end of the other blade 14 defining the channel 24. The radial distance of the point of impact is indicated by the dotted line 80 in FIG. 1 and the general location of the inner end of the blade 14 is indicated at 82 in FIGS. 1 and 2.

As previously described, the flow of the majority of drilling fluid from the inner nozzle 48 outwardly along the channel 24 may tend to cause a reduction in pressure in the inner end of the associated channel 26. However, this low pressure area is fed by inward flow of drilling fluid from the peripheral nozzle 54.

As best seen in FIG. 2, the central axis 84 of the nozzle 54 is inclined at an angle 86 to the bit surface 72 which is less than 90° so that the direction of flow of fluid from the nozzle 54 has a component inwardly along the channel 26 and towards the associated inner nozzle 48. Fluid emerging under pressure from the nozzle 54 therefore impinges on the formation 76 and then tends to flow inwardly along the channel 26 as indicated by the arrow 88 in FIGS. 1 and 2. However, a minor proportion of the flow from the nozzle 54 may flow outwardly and upwardly through the junk slot 38 to the annulus 90 between the drill string and the formation 76.

It is found that the combination of inner and outer fluid nozzles arranged and orientated in the manner just described provides a particularly effective and beneficial flow of drilling fluid across the cutting structures and on to the formation in a manner to provide effective cleaning and cooling of the cutting elements, and cooling of the formation, while reducing the tendency of the channels to become blocked by accumulation or "bailing" of the cuttings, which is particularly likely to occur with soft and sticky formations.

It will be appreciated that the invention is not limited to the particular arrangement shown in the drawings and, as previously mentioned, a bit in accordance with the invention may have only one pair of associated peripheral and inner nozzles. Arrangements are also possible in which two peripheral nozzles, adjacent different junk slots in the gauge region, both direct drilling fluid inwardly towards the same inner nozzle. Conversely, in some cases a single peripheral nozzle may direct drilling fluid inwardly towards two inner nozzles. As previously mentioned, the bit may also be provided with further nozzles, such as inner or peripheral nozzles, which are not associated in the manner according to the invention with other nozzles on the drill bit.

I claim:

1. A rotary drill bit for use in drilling holes in subsurface formations comprising a bit body having a leading face and a gauge region, a plurality of blades formed on the leading face of the bit and extending outwardly away from the axis of the bit towards the gauge region so as to define between the blades a plurality of fluid channels leading to junk slots in the gauge region, each channel having an inner end and an outer end, a plurality of cutting elements mounted along each blade, and a plurality of nozzles in the leading face of the bit for supplying drilling fluid to the channels for cleaning and cooling the cutting elements, wherein at least two of said channels are in communication with one another at their inner ends and both lead to respective junk slots at their outer ends, and wherein there is provided, in the vicinity of said communicating inner ends of the channels, an inner nozzle which is angled with respect to the surface of the bit body to direct drilling fluid in a direction having a component outwardly along one of said two channels, so as to direct the majority of fluid emerging from said nozzle outwardly along said one channel, and an outer nozzle located in the other of said two channels, said outer nozzle being located at the outer end of said other channel and adjacent the respective junk slot to which said other channel leads, and being angled with respect to the surface of the bit body to direct drilling fluid in a direction having a component inwardly along said other channel, so that the majority of fluid emerging from said outer nozzle flows inwardly along said other channel and towards said inner nozzle.

2. A rotary drill bit according to claim 1, wherein said inner nozzle is angled to direct drilling fluid along said one channel in a direction which is generally parallel to the blade along which are mounted the plurality of cutting elements which face into said one channel.

3. A rotary drill bit according to claim 1, wherein the centreline of the flow of drilling fluid from said inner nozzle impinges on the formation, in use, at a radial distance from the central axis of rotation of the drill bit which is greater than the radial distance from the axis of the inner end of the other blade along which said channel extends.

4. A rotary drill bit according to claim 1, wherein the inner nozzle is located as close to the central axis of rotation of the drill bit as permitted by the location of the blades and cutting elements.

* * * * *